United States Patent [19]

Price, Jr.

[11] Patent Number: 4,494,458

[45] Date of Patent: Jan. 22, 1985

[54] TYPEHOLDING CHASE

[75] Inventor: Lewis C. Price, Jr., Yonkers, N.Y.

[73] Assignee: Dennison Manufacturing Company, Framingham, Mass.

[21] Appl. No.: 517,619

[22] Filed: Jul. 27, 1983

[51] Int. Cl.[3] ..... B41B 1/18

[52] U.S. Cl. ..... 101/391; 101/381

[58] Field of Search ..... 101/28, 391, 393, 394, 101/396, 377, 370, 380, 381; 276/36-43; 40/489

[56] References Cited

U.S. PATENT DOCUMENTS

| | | | |
|---|---|---|---|
| 789,708 | 5/1905 | Bhisey | 101/396 X |
| 921,974 | 5/1909 | Ginsburg | 101/391 X |
| 4,239,002 | 12/1980 | Rosenstein | 101/377 |

FOREIGN PATENT DOCUMENTS

| | | | |
|---|---|---|---|
| 29165 | 12/1956 | Fed. Rep. of Germany | 101/391 |

*Primary Examiner*—Paul T. Sewell
*Assistant Examiner*—Moshe I. Cohen
*Attorney, Agent, or Firm*—Barry D. Josephs; George E. Kersey

[57] ABSTRACT

A typeholding chase which positively clamps rubber type elements, and firmly engages the elements during high speed machine operation. The chase provides secure engagement of type elements, while facilitating interchange of such elements without a need for separate tools. The chase houses a plurality of resilient support members including mounting surfaces as well as spacer blocks and a bias plate for inducing a type clamping force.

14 Claims, 3 Drawing Figures

TYPEHOLDING CHASE

BACKGROUND OF THE INVENTION

The present invention relates to print head designs for impact printers, and more particularly to improved type chases for reciprocating stamping machines.

One particular category of impact printer, to which the present invention relates, is the reciprocating stamping machine. This machine incorporates one or more "typeholding chases", each of which houses a plurality of type "sorts" to define the image. In one particular version of this machine, the type sorts consist of elastomeric members which include formed backings to engage the type housing. These devices typically utilize a high speed reciprocating motion of such print heads to create hundreds of impressions per minute. Such typeholding chases should therefore firmly engage the individual type elements to prevent accidental release due to normal machine motions, incidental vibrations, etc. A suitable design of such print heads should also facilitate removal and interchange of type sorts by the user in order to change the impression.

An article in the Jan. 18, 1982 issue of *Design News*, "Spring-loaded Pucks Lock Type in Place", by Bernard Gill of Kiwi Coder Corporation, Wheeling, IL, discloses a typeholding chase of this general description. The print head disclosed in this reference suffers the shortcoming that it requires the use of tools in the interchange of type sorts, in order to adjust internal mechanisms which are part of the disclosed system.

Accordingly, it is a principal object of the invention to provide an improved typeholding chase for impact printers. A related object is to provide a typeholding chase which is particularly suited to high speed stamping machines using reciprocating print heads.

Another object of the invention is to achieve a print head design which firmly locks type sorts in place during machine operation. It is a related object that the print head incorporate mechanisms which will not release type sorts during machine operation, but will simplify the removal of these sorts when this is desired.

A further object of the invention is that such print head designs facilitate the interchange of type sorts to change the print head impression. A related object is to avoid the need for tools or special manipulation of mechanisms within the print head for type sort interchange.

SUMMARY OF THE INVENTION

The above and additional objects are satisfied in the typeholding chase of the invention, which is suitably incorporated in a high speed stamping machine. The typeholding chase includes a number of resilient support members preferably arranged in pairs. Each pair of support members includes mounting portions which act as clamping surfaces for engaging type elements. The resilient support members include camming surfaces and means are provided for biasing the camming surfaces and thereby biasing the mounting portions.

In accordance with one aspect of the invention, resilient support members preferably are formed of flat spring structures, which are shaped in accordance with the novel design of the invention. The support members are advantageously configured so that each pair has bilateral symmetry around a line through the engaged portion of the type sort. In the preferred embodiment, the convex mounting portions mate with complementary cavities in the type sort backings; in the preferred embodiment, these upper portions form a circular or elliptical profile, and engage grooves in the type sort backings. Each support member pair also includes camming surfaces, preferably in the form of inclined planes, which translate an upward bias exerted thereon into a diverging bias of the type-engaging portions.

Another aspect of the invention relates to a mechanism for providing a controlled bias of the support members. In the preferred embodiment, each pair of support members is placed astride a block which exerts an upward bias against the camming surfaces. Advantageously, these blocks also anchor the support members, and act as spacers between base portions thereof. In the preferred embodiment, the typeholding chase incorporates an internal plate which is pressed against the spacers to achieve a preselected upward tensioning; this is adjusted by the user and need not be readjusted during type interchange.

A further aspect of the invention relates to the housing and stacking of a plurality of resilient support members. The typeholding chase includes a superstructure, such as a rectangular housing, and further includes a pin which is inserted through apertures in the support members. This pin interconnects the various support member pairs to tightly group them within the housing. The housing may further include a removeable base plate.

BRIEF DESCRIPTION OF THE DRAWINGS

The above and further aspects of the invention are illustrated in the detailed description which follows, which should be taken together with the drawings in which.

DETAILED DESCRIPTION

Figure 3:
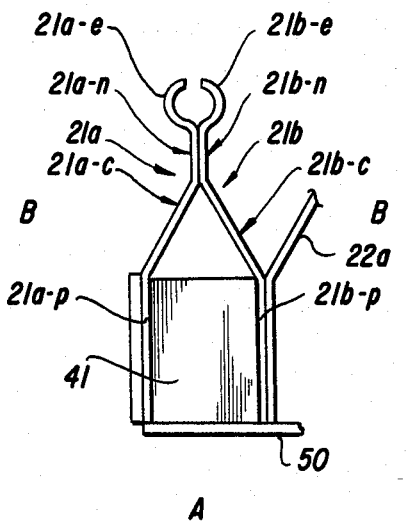
FIG. 3 is a partially schematic view of a support member pair from the typeholding chase of FIG. 1, with associated spacer.
Figure 1:
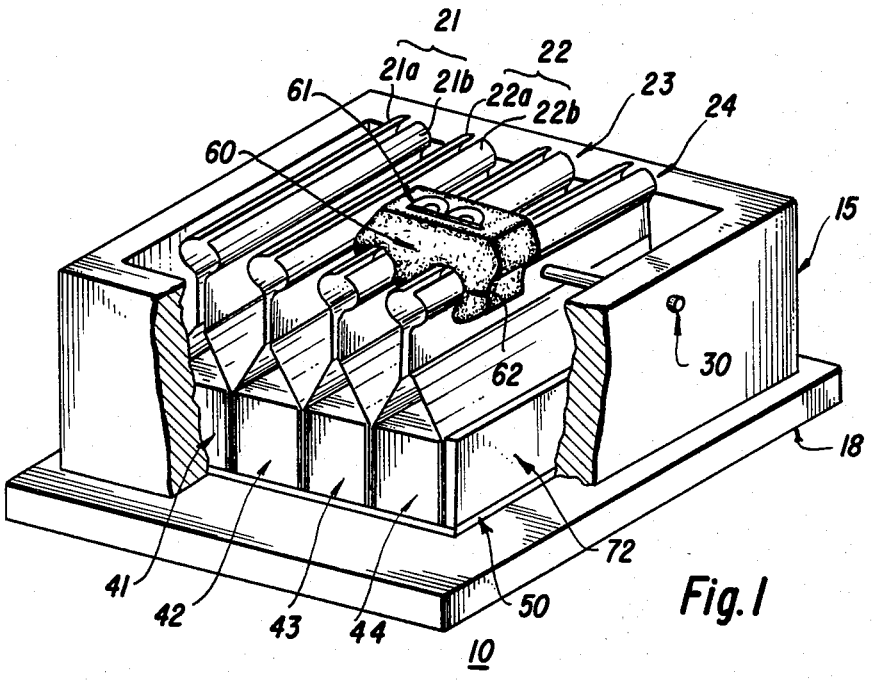
FIG. 1 is a partially cut-away perspective view of a typeholding chase according to a preferred embodiment of the invention.
Figure 2:
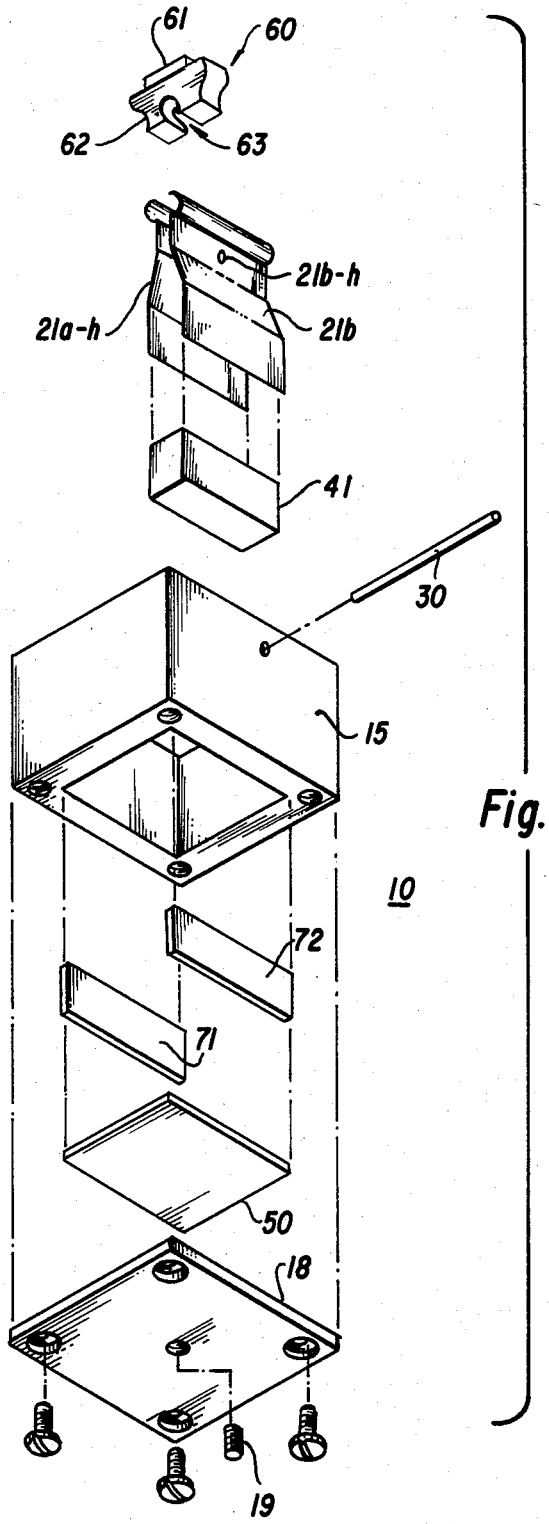
FIG. 2 is a break away view of the typeholding chase of FIG. 1.

Reference should now be had to FIGS. 1–3 for a detailed description of a preferred typeholding chase embodying the invention. FIG. 1 shows a typeholding chase or printhead 10 partially cut-away to reveal its internal structures. The principal elements of print head 10 are its superstructure including rectangular housing 15 and base plate 18; a series of support member pairs 21*a* and 21*b*, 22*a* and 22*b*, etc; a pin 30 for stacking the support members; a series of spacers 41, 42, etc; and a bias plate 50. The chase 10 engages a plurality of type sorts 60, only one of which is shown in FIG. 1, including an upper typeface 61 and lower, backing portion 62 which illustratively defines a cylindrical groove 63. Type sorts of this variety are well known, such as the elastomeric type sorts sold under the tradename "Base-lock" (Base-lock is a trademark of the Pryor Marking Products Co. of Chicago, IL).

In the illustrated embodiment, the support members 21, 22 comprise resilient structures formed of flat, resilient material, shaped to meet the requirements of the invention as described below. As seen in FIG. 1, the various pairs of flat spring members 21, 22, etc. include upper mounting surfaces for engaging a plurality of type sorts 60. The typeholding chase 10 has been designed for incorporation in high speed stamping machines. Such machines commonly utilize a reciprocating motion to impress individual print heads 10, after inking, against an article to receive a desired impression. Inasmuch as such machines typically have cycle speeds of several hundred impressions per minute, it is important to provide a typeholding chase which will not "throw" its type sorts under these conditions. The device disclosed herein achieves the required firm engagement, while simplifying the task of interchanging type sorts to provide a different impression, as described below.

The support pairs 21, 22, etc. are held in a vertical orientation within the rectangular housing 15, by anchoring the individual supports at their bases between spacers 41, 42, etc. A given spacer 41 illustratively takes the form of a rectangular block. Additional spacers 71 and 72 may be inserted abreast the extreme support members to provide a proper separation from the walls of housing 15. The stacking of the support members is further controlled by a pin 30, which is inserted through apertures 21*a–h*, 21*b–h*, etc. near the upper portion of each support (FIG. 2). This pin 30 thus interconnects the various supports near their tops and tightly bunches them to achieve an even spacing of their type-engaging portions 21*a–e*, 21*b–e*, etc. The various elements within housing 15 are contained from below by a base plate 18.

The typeholding principle embodied in the print head 10 utilizes a novel geometry of the resilient support members. As may be seen in FIGS. 2 and 3, a given support member pair 21 is advantageously characterized by a bilateral symmetry around a central vertical line which passes through the engaged portion of a type element 60. A particular support member 21*a* includes a base portion 21*a–p;* a camming portion 21*a–c* in the form of an inclined plane; a neck portion 21*a–n;* and an upper portion 21*a–e* which engages a given type sort 60 at its base aperture 63. With particular reference to FIG. 3, the various portions of support members 21 are configured so that the neck portions 21*a–n*, 21*b–n* are in contact. While in this arrangement, the base portions 21*a–p* and 21*b–p* will be separated by an interval corresponding to the width of spacer 41. The sloping portions 21*a–c* and 21*b–c* provide camming surfaces to achieve the desired tensioning action described below.

With further reference to FIG. 2, the print head 10 includes an internal plate 50 which is inserted below the spacers 41, 42, etc. A jack screw 19 through base plate 18 exerts an upward force against plate 50, as indicated by the arrow A in FIG. 3. This causes the upper corners of spacers 41, 42, etc. to wedge against the respective camming surfaces of support member pairs 21, 22, etc., which induces an outward force on these members as indicated by arrows B. This leads to a diverging bias of the type-engaging portions 21*a–e*, 21*b–e*, thus providing a firm engagement of the type sorts 60. This clamping pressure is controlled by the user through jack screw 19, and need not be adjusted during type interchange. Thus, the removal and replacement of type elements 60 requires no separate tools or manipulation of internal elements of print head 10.

While various aspects of the invention have been set forth by the drawings and the specification, it is to be understood that the foregoing detailed description is for illustration only and that various changes in parts, as well as the substitution of equivalent constituents for those shown and described, may be made without departing from the spirit and scope of the invention as set forth in the appended claims.

I claim:

1. A holder for type elements having opposed concave mounting surfaces, comprising:

a housing;

a plurality of type clamps contained within said housing, each of said type clamps comprising a pair of resilient support members spaced from each other and each resilient support member having an outwardly convex mounting portion, a camming portion, and a base portion; and means for biasing the camming portions of each pair of resilient support member away from each other, to cause the respective mounting portions to diverge from each other and engage the concave mounting surfaces of the type elements.

2. A type holder as defined in claim 1 wherein each of the resilient support members within a pair are disposed in bilateral symmetry.

3. A type holder as defined in claim 1 wherein the mounting portions of each pair of resilient support members form a circular or elliptical composite, which fits within a groove in said type element.

4. A type holder as defined in claim 1 wherein the resilient support members comprise flat spring members.

5. A typeholder as defined in claim 1 wherein the type clamps extend along a first axis of said housing, further including means for bunching the type clamps along a second, transverse axis of said housing.

6. A typeholder as defined in claim 5 wherein the means for bunching said type clamps comprises a stacking pin which is inserted through apertures in the various type clamps.

7. A type holder as defined in claim 1, wherein the camming portion of each resilient support member comprises an inclined plane.

8. A typeholder as defined in claim 7, wherein the biasing means for a given pair of support members comprises a block which contacts the inclined planes.

9. A type holder as defined in claim 8, wherein said biasing means further comprises a biasing plate which exerts a preselected force against said blocks.

10. A type holder as defined in claim 8 wherein each block is placed between base portions of a corresponding pair of resilient support members to anchor these base portions.

11. A holder for type elements having opposed concave mounting surfaces, comprising:

a housing;

a plurality of type clamps contained within said housing, each of said type clamps comprising a pair of resilient support members spaced from each other and each resilient support member including an outwardly convex mounting portion as well as an inclined planar camming surface, and a base portion;

for each pair of resilient support members, a spacer block placed between the base portions and abutting against the inclined planar surfaces; and means for biasing each spacer block against the inclined planar surfaces so as to induce a divergent bias on said outwardly convex mounting portions, which engage the concave mounting surfaces of the type elements.

12. A type holder as defined in claim 11, wherein each of the resilient support members extends along a first axis of said housing and contains an aperture adjacent its mounting portion, further comprising a pin which is inserted through the apertures of the resilient support members to bunch them along a second, transverse axis.

13. A typeholder as defined in claim 23, wherein the biasing means comprises a biasing plate which presses the spacer blocks against the inclined planar surfaces with a preselected force.

14. A holder for type elements having opposed concave mounting surfaces, comprising:

a housing;

a plurality of type clamps contained within said housing, each of said type clamps comprising a pair of resilient support members spaced from each other and each resilient support member including an outwardly convex mounting portion as well as an inclined planar camming surface, and a base portion;

for each pair of resilient support members, a spacer block placed between the base portions and abutting against the inclined planar surfaces; and a biasing plate which presses the spacer blocks against the inclined planar surfaces so as to induce a divergent bias on said mounting portions, which engage the concave mounting surfaces of the type elements.

* * * * *